United States Patent [19]

Debs

[11] Patent Number: 4,742,860

[45] Date of Patent: May 10, 1988

[54] SPLICED VERTICAL BLIND HEAD

[75] Inventor: Victor Debs, Staten Island, N.Y.

[73] Assignee: Levolor Lorentzen, Inc., Lyndhurst, N.J.

[21] Appl. No.: 228,784

[22] Filed: Jan. 27, 1981

Related U.S. Application Data

[63] Continuation-in-part of Ser. No. 120,309, Feb. 11, 1980.

[51] Int. Cl.[4] ..... E06B 9/38

[52] U.S. Cl. ..... 160/178.1; 160/166.1

[58] Field of Search ..... 403/292, 293, 306, 300, 403/363; 16/96 R, 96 D, 95, 94 R, 94 D; 160/345, 178 R, 166 A; 52/726

[56] References Cited

U.S. PATENT DOCUMENTS

| | | | |
|---|---|---|---|
| 55,198 | 5/1866 | Baum | 403/306 |
| 2,837,152 | 6/1958 | Moore, Jr. | 160/223 X |
| 3,345,678 | 10/1967 | Graber et al. | 16/94 D |
| 4,069,638 | 1/1978 | Hasselquist | 403/363 |
| 4,122,884 | 10/1978 | Salzmann | 160/178 R |

FOREIGN PATENT DOCUMENTS

| | | | |
|---|---|---|---|
| 2235664 | 1/1975 | France | 16/96 D |
| 2262748 | 9/1975 | France | 403/300 |

*Primary Examiner*—Ramon S. Britts
*Assistant Examiner*—David M. Purol

[57] ABSTRACT

A vertical blind head having two separate parts interconnected by a bracket or the like and having a split tilt rod whose parts are interconnected by a sleeve or pin.

8 Claims, 2 Drawing Sheets

SPLICED VERTICAL BLIND HEAD

BACKGROUND OF THE INVENTION

This is a Continuation-In-Part Application of my copending application Ser. No. 120,309, filed Feb. 11, 1980, now abandoned.

The present invention relates to vertical blinds, and more specifically relates to a head for a vertical blind. Such vertical blind head may have a considerable length such as 10 or 20 feet, especially if intended for use in commercial buildings. The shipping of such long vertical blind heads has proved quite cumbersome and expensive, since costs increase considerably with increased length of an item being shipped. Also, some carriers have maximum size limitations beyond which packages will not be accepted for shipment.

It is, therefore, an object of the present invention to provde a vertical blind head which can be shipped at reduced cost. This has been accomplished by splitting the vertical blind head into two parts, which of course, requires also splitting the tilt rod of the vertical blind into two parts, and providing means for coupling the blind head parts as well as the tilt rod parts, prior to installation of the blind head.

BRIEF DESCRIPTION OF THE DRAWINGS

The present invention is illustrated, by way of example, in the accompanying drawings, in which.

DETAILED DESCRIPTION OF PREFERRED EMBODIMENTS

Figure 1:
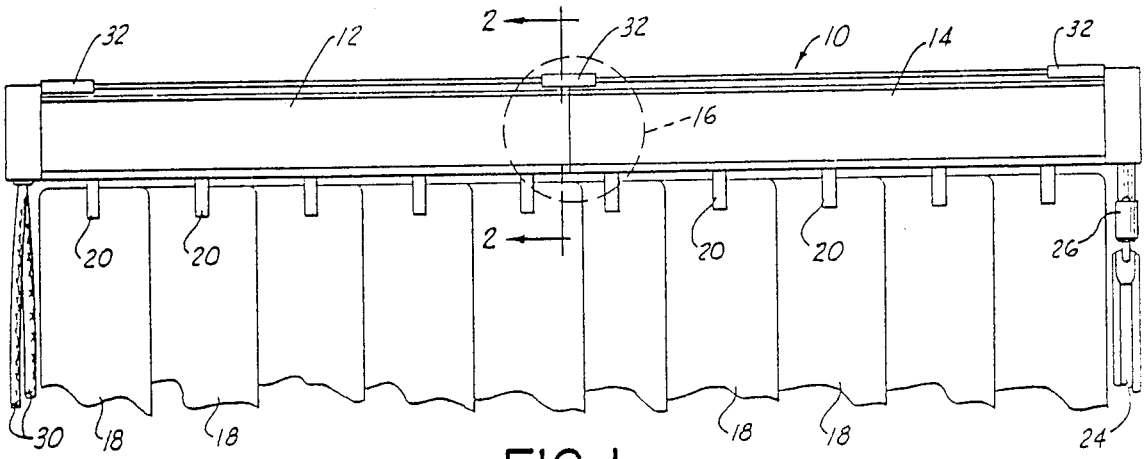
FIG. 1 is a front view of a vertical blind including a vertical blind head.
Figure 2:
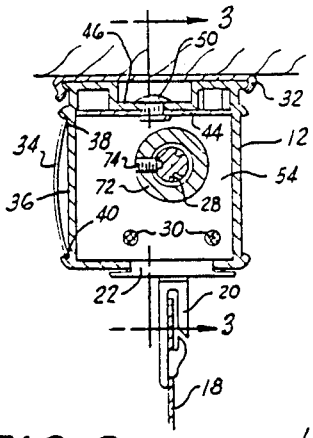
FIG. 2 is a section taken along the line 2—2 of FIG. 1 through the blind head.

FIG. 1 shows a vertical blind head, generally designated with the reference 10. For purposes of facilitating shipping of the vertical blind head, it is made in two parts 12 and 14. These parts are joined at 16. The particular form of connection will be described in greater detail further below. A number of vertical vanes 18 are suspended from the vertical blind head 10 by means of holders 20 which in turn are supported within the vertical blind head 10 by means of carriers 22. In customary manner, the vertical blind shown in FIG. 1 also comprises a wand 24, which through the intervention of intermediate member 26, may rotate a tilt rod. All elements described so far with the exception of the junction 16 are known in the art and are, for instance, described in greater detail in Applicant's U.S. Pat. No. 4,214,622 issued July 29, 1980, as is the operation of the tilt rod by the wand 24. Suffice it to say that rotation of wand 24 in clockwise or counter-clockwise direction, respectively, will rotate the tilt rod and thereby the holders 20 and vanes 18 to thereby respectively open or close the blind. Also, in well-known manner, the vertical blind is provided with a traverse cord 30 which serves for traversing the vanes 18 to the right or to the left.

The vertical blind head 10 may be suspended from a ceiling by means of brackets 32 and may have a decorative valance 34 covering the front 36 of the blind head. Valance 34 is received in grooves 38 and 40 in blind head 10.

Referring now specifically to the invention and first to the embodiment of FIGS. 1 to 5, as mentioned above, the vertical blind head 10 is composed of two parts 12 and 14. Each part is provided with a bracket 42, 44, respectively. The brackets are connected to the respective top wall 46, 48 of part 12 and 14 by rivets 50, 52, respectively. Similarly, the tilt rod is composed of two parts 28 and 29. Bracket 42 has a downwardly extending portion 54 with a relatively small sleeve 56 having an opening through which a portion of tilt rod part 28 extends. Similarly, bracket 44 has a downwardly extending portion 58 with a small sleeve 60 through which a portion of the tilt rod part 29 extends. The traverse cord 30 is passed through openings 62 and 64 in parts 12 and 14, respectively.

Figure 3:
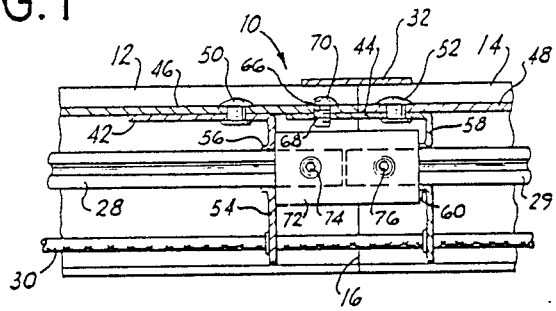
FIG. 3 shows the encircled portion of FIG. 1 in section taken along the line 3—3 of FIG. 2.

Part 12 of the vertical blind head and the bracket 44 of part 14 are respectively provided with openings 66 and 68 which, when the parts 12 and 14 engage each other as shown in FIG. 3, are aligned with each other so that a screw 70 can be passed therethrough to interconnect parts 12 and 14.

The means for interconnecting the parts 12 and 14 also include a sleeve 72 which is connected to part 28 of the tilt rod by means of a set screw 74. Once the parts 12 and 14 have been joined by screw 70, a screw 76 can be screwed into sleeve 72 to connect the tilt rod part 29 rotatably to the tilt rod part 28 by means of the sleeve 72.

Figure 4:
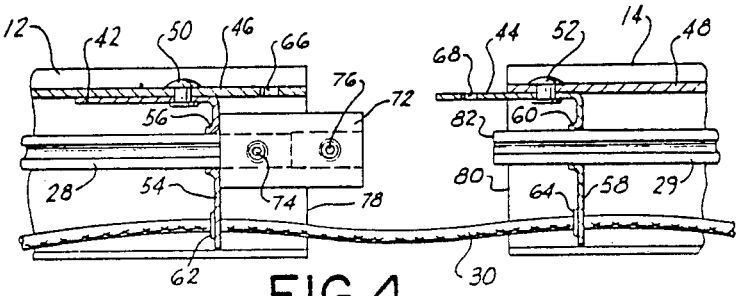
FIG. 4 shows the two parts of the vertical blind head of FIG. 3, when taken apart.
Figure 5:
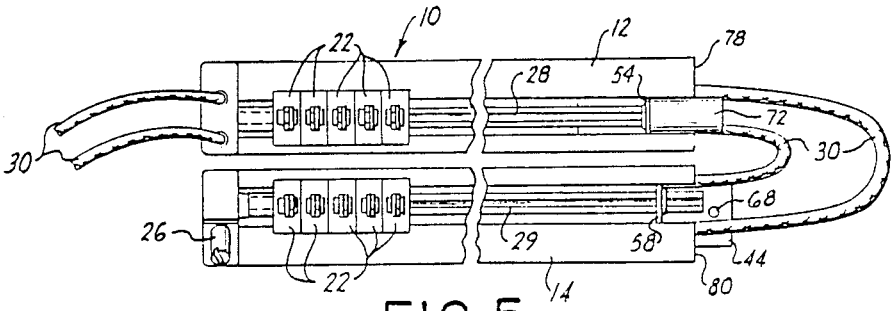
FIG. 5 is a bottom view of the two parts of the vertical blind head, assembled prior to shipping.
Figure 6:
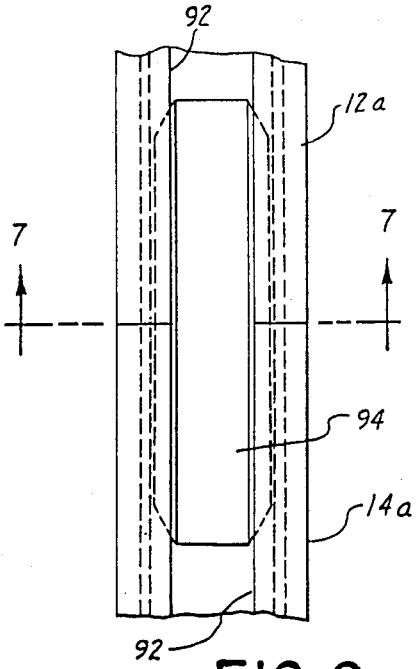
FIG. 6 is a top view of another embodiment of a split vertical blind head.
Figure 8:
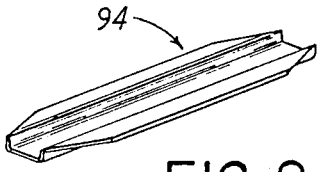
FIG. 8 is a perspective view of a channel-shaped piece for interconnecting the two parts of the blind head of FIG. 6.

It will be noted from FIGS. 4 and 5 that bracket 54 is spaced from the end face 78 of part 12 a greater distance than the portion 58 is spaced from end face 80 of part 14. It makes it easier to join parts 44 and 46 on the one hand and parts 28 and 29 on the other if the ends of parts 28 and 29 are not exactly in the center, that is, if the end face 82 of tilt rod part 29 is not in the same plane but extends somewhat beyond the end face 80 of vertical blind head part 14. However, this arrangement is not absolutely necessary, i.e. the lines of separation of the head parts and tilt rod parts could be located in the same plane.

FIG. 5 shows the two parts 12 and 14 of the vertical blind head in the position in which it is ready for shipping. Due to the arrangement of the present invention a vertical blind head of considerable length can be split and shipped at reduced cost.

Figure 7:
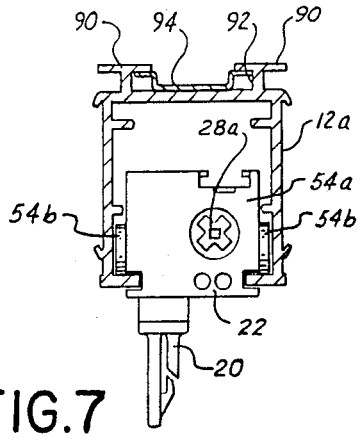
FIG. 7 is a section taken along the line 7—7 of FIG. 6.
Figure 9:
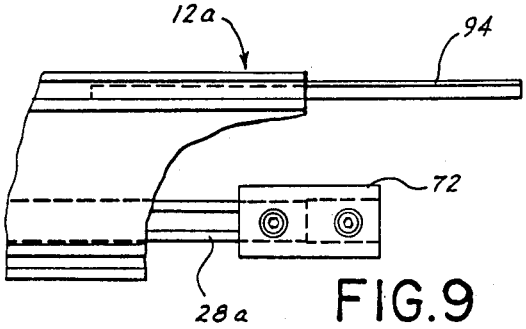
FIG. 9 is a side view of the two head parts of the embodiment of FIGS. 6 to 8, when spaced apart.

A second embodiment of the invention is illustrated in FIGS. 6 to 9, in which the same parts are designated with the same reference numerals as in FIGS. 2 to 5 and similar elements carry the suffix "a". The blind head has two parts 12*a* and 14*a*. Each head part differs from that of FIGS. 2 to 5 in that its top part is provided with two parallel T-shaped extensions 90 which define a channel-shaped passage 92 which is adapted to receive therein snugly a complementary channel 94. As shown in FIG. 7, channel 94 extends from space 92 of head part 12*a* into space 92 of head part 14*a*, and thereby fixedly interconnects these two head parts. Similarly, a sleeve 72 interconnects parts 28*a* and 29*a* of the tilt rod which has a different cross-section than that shown in FIGS. 2 to 5. Also, the carrier 54*a* is supported by rollers 54*b* rather than sliding on the bottom of the blind head.

Figure 10:
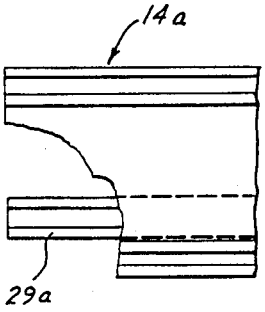
FIG. 10 shows the two parts of a split tilt rod, modified when compared with those shown in FIGS. 2 to 5 and FIGS. 7 and 9, respectively.
Figure 10:
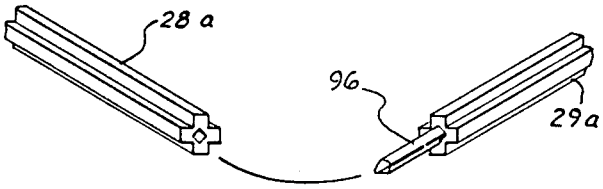
Figure 11:
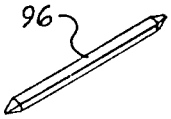
FIG. 11 is a perspective view of a pin used in connecting the two parts of the tilt rod shown in FIG. 10.

In still another embodiment shown in FIGS. 10 and 11, the tilt rod parts 28*a*, 29*a* are interconnected by a pin 96 forced into openings in the respective ends of the tilt rod parts.

It is, of course, to be understood that if a vertical blind head of even greater length is involved, it could be spliced more than once to form, for instance, three or more parts.

I claim:

1. In combination: a vertical blind head channel having a first elongated channel part and a separate second elongated channel part of the same cross section as said first part, a tilt rod having a first elongated portion rotatably supported in said first part and also having a second elongated portion separate from said first portion and of the same cross section as said first portion, said second portion being rotatably supported in said second part, first means for removably connecting said first and second head channel parts in longitudinal alignment and essentially in abutting relationship with each other, and second means for removably connecting said first and second tilt rod portions in axial alignment and essentially in abutting relationship with each other.

2. A vertical blind head according to claim 1, wherein said first means comprises a bracket connected to one of said parts and protruding beyond said one part towards said other part and means for connecting said bracket to said other part.

3. A vertical blind head according to claim 1, wherein said second means comprises a sleeve removably connected to one of said portions and extending therefrom towards said other portion, and means for connecting said other portion to said sleeve.

4. A vertical blind head according to claim 3, wherein one of said portions extends beyond said one part.

5. A vertical blind head according to claim 1, wherein said first and second parts have passage means, and wherein said first means comprises a piece snugly received within said passage means.

6. A vertical blind head according to claim 5, wherein said piece is channel-shaped.

7. A vertical blind head according to claim 1, wherein said second means is a pin having ends respectively received in said first and second portions.

8. A vertical blind head according to claim 7, wherein said pin is force-fit in said first and second portions.

* * * * *